US006019200A

United States Patent [19]

Janzen et al.

[11] Patent Number: 6,019,200

[45] Date of Patent: Feb. 1, 2000

[54] DEVICE FOR BRAKING ELECTRICALLY CONDUCTING STRIPS

[75] Inventors: Klaus Janzen, Lunen; Wilhelm Cassing, Werne, both of Germany

[73] Assignee: Tridelta Magnetsysteme GmbH, Dormund, Germany

[21] Appl. No.: 08/981,885

[22] PCT Filed: Jun. 14, 1996

[86] PCT No.: PCT/EP96/02572

§ 371 Date: May 29, 1998

§ 102(e) Date: May 29, 1998

[87] PCT Pub. No.: WO97/02103

PCT Pub. Date: Jan. 23, 1997

[30] Foreign Application Priority Data

Jul. 6, 1995 [DE] Germany ..... 195 24 289

[51] Int. Cl.[7] ..... B60L 7/00; B65H 23/24

[52] U.S. Cl. ..... 188/163; 242/419.3

[58] Field of Search ..... 188/163; 242/419.3; 118/673; 198/813

[56] References Cited

U.S. PATENT DOCUMENTS

| | | | |
|---|---|---|---|
| 2,731,212 | 1/1956 | Baker . | |
| 3,380,686 | 4/1968 | Gaudin | 242/419.3 |
| 3,433,398 | 3/1969 | Fadden et al. | 242/419.3 |
| 3,824,516 | 7/1974 | Benowitz | 335/284 |
| 4,655,166 | 4/1987 | Nishimura et al. | 118/673 |
| 4,915,318 | 4/1990 | Morrison | 242/56.2 |
| 5,337,608 | 8/1994 | Egan et al. | 73/865.6 |
| 5,346,155 | 9/1994 | Alexander et al. | 242/334 |

FOREIGN PATENT DOCUMENTS

| | | | |
|---|---|---|---|
| 1 543 492 | 9/1967 | France | 242/419.3 |
| 1543492 | 10/1968 | France | 242/419.3 |
| 1 288 865 | 2/1969 | Germany . | |
| 2 246 558 | 9/1972 | Germany | 242/419.3 |
| 96 206 | 3/1973 | Germany . | |
| 2 301 434 | 10/1973 | Germany | 242/419.3 |
| 29 06 707 A1 | 8/1979 | Germany . | |
| 22 46 558 | 8/1980 | Germany . | |
| 2 073 150 | 10/1981 | United Kingdom . | |

*Primary Examiner*—Robert J. Oberleitner
*Assistant Examiner*—Jeffrey Woller
*Attorney, Agent, or Firm*—Proskauer Rose LLP

[57] ABSTRACT

A device is proposed for braking an electrically conducting strip (B), said device being mounted in front of a processing station where the strip (B) under tension undergoes further processing and is provided with a magnetic field generating device (3). The latter generates an alternating magnetic field which induces eddy currents in the strip (B) which in turn exert on the strip a force in a direction against the strip's direction or travel (F). The magnetic field generating device (3) comprises at least one rotating magnetic roller (4, 5) which is aligned transversely in relation to the direction of travel of the strip (B) and is provided around its circumference with magnetic poles (6, 7) of differing polarity in alternating sequence. The direction of rotation (R) of the magnetic roller (4, 5) is opposite to the direction of travel (F) of the strip (B).

6 Claims, 1 Drawing Sheet

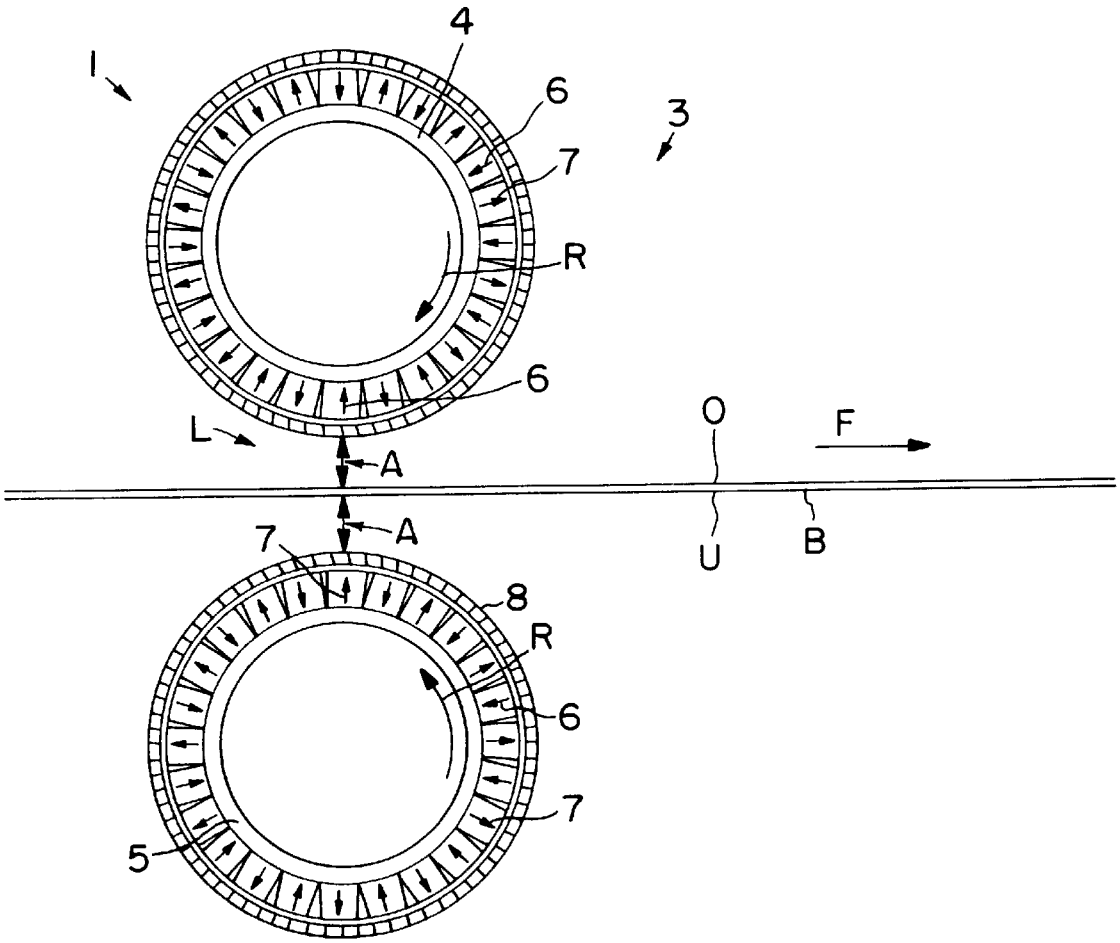
1
4
6
3
7
R
6
L
A
O
F
U
B
7
A
8
R
6
7
5

DEVICE FOR BRAKING ELECTRICALLY CONDUCTING STRIPS

The present invention relates too a device for the braking of electrically conducting strips provided with a device for the production of a magnetic field, which is located before a processing station in which the strip being subjected to traction is further processed, whereby the magnetic field producing device produces an alternating magnetic field which induces eddy currents into the strip, these currents exerting a force upon the strip that is contrary to the direction of its movement Devices of the type mentioned above are used to hold strips under a constant tension while they are conveyed to a station for further processing. Such a station for further processing could be a winding device in which the strips of a band previously divided lengthwise are wound up into individual coils of smaller width. In such devices tight winding with precise edges of the individual metal strip bands without danger that the strip runs off center is only possible if the strips are held under constant tension.

In conventional braking devices known in practice, the traction on the strips is produced by means of braked rollers lying on the surface of the strip and running with the strip. The disadvantage of such devices is that the contact between the strip and the rollers exposes the strip surface to the danger of becoming damaged. This applies even when the rollers are provided with a soft lining, as a certain frictional force must always be produced between strip and roller in order to achieve the necessary braking effect. It has therefore been attempted to use presses covered with felt for the purpose of braking. However, due to the considerable pressing forces, these have the same disadvantages as the rollers described earlier.

In devices for the braking of electrically conductive strips known in practice and which the applicant is unable to document in further detail through printed documents the above-mentioned disadvantages are found only to a lesser degree. In the known devices a static magnetic field is produced by means of the magnetic field generating device, said magnetic field inducing eddy currents in the strip which is moving relative to the magnetic field. The strip is braked by these eddy currents. The advantage of such devices consists in the fact that braking and the build-up of tensile stress occur without contact. It is however a disadvantage that the braking effect depends directly on the speed of the strip. For this reason it is required also with this known device to brake the strip mechanically when it is stopped, e.g. before starting up the downstream processing station.

Devices of the type mentioned initially no longer have the above-mentioned disadvantages. Such devices are known e.g. from U.S. Pat. No. 2,731,212 or from the German application DE-AS 22 46 558. The known devices produce a magnetic field of alternating polarity, so that an eddy current subjected essentially to no influence from the movement of the strip is induced in the strip captured by this magnetic field. Whatever the width of the strip may be, this eddy current exerts a force on the strip that is opposed to the direction of movement of said strip. Based on the fact that in the known devices the apparatus for the production of a magnetic field itself produces an alternating magnetic field, the eddy current is effective even when the strip is stopped. The known braking device has the disadvantage that considerable expenditures for equipment and controls are necessary in order to adapt braking force exerted by the device for the production of a magnetic field on the strip to the requirements of a given operating situation. The complexity of controls and the costs involved to implement it make this more expensive in manufacture and maintenance than known braking devices.

It is the object of the present inventing to create an efficient and at the same time easily made device of the type mentioned initially based on the above mentioned devices, by means of which it is possible to brake a strip without contact and independently of its movement.

This object is attained by the invention in that the magnetic field generating device comprises at least one rotatable magnetic roller which is perpendicular to the direction of movement of the strip and is provided on its circumferential surface in alternating succession with magnetic poles of different polarity, and in that the direction of rotation of the magnetic roller is contrary to the direction of movement of the strip. An alternating magnetic field can be built up by means of such magnetic rollers, their alternating frequency depending solely on the rotational speed of the roller. This makes it possible to adapt the magnitude of the eddy currents induced into the strip and thereby the magnitude of the braking force in a simple manner to the current requirements.

A device according to the invention equipped with magnetic rolls of the type described above is especially effective if at least one such magnetic roller is assigned to the top and another one to the underside of the strip. In this manner the braking force is increased on the one hand. On the other hand this arrangement of the magnetic rollers in pairs achieves a centering of the strip in the air gap remaining between the magnetic rollers.

Another possibility to easily regulate the effectiveness of the magnetic field or the braking force acting upon the band is provided if the distance between the magnetic rollers and the strip is adjustable. The adjustability of the distance furthermore makes it possible to adapt the alignment of the strip in the air gap to the existing requirements.

Depending on the application, it may be advantageous if the magnetic poles of the magnetic roller are formed by permanent magnets or solenoids.

The device according to the invention is especially well suited for utilization in production lines in which non-iron strips are processed in case that magnetic rollers of the type described above are used. In case that the device according to the invention is also used for the processing of ferromagnetic strips, it is advantageous for the magnetic roller to be surrounded by a casing made of a non-conductive material. This casing can prevent the strip from adhering to the magnetic rollers due to its great capacity of becoming magnetized. It is especially advantageous in that case if the casing is elastic. When using such a casing the danger of damage to the strip surface is reduced, even when the strip surface touches the roller. This applies in particular if the casing is made in the manner of a sleeve and rotates at a circumferential speed equal to the conveying speed of the strip, independently of the rotation of the magnetic roller.

The invention is explained in further detail below through a drawing showing an example of an embodiment.

The single FIGURE shows a device for the braking of a magnetic roller, in a schematic lateral view.

The device 1 for the braking of a strip (B) is installed in direction of travel (F) before a winding station in which the strip (B) is wound up into a coil which is also not shown here. The device 1 is provided with a magnetic field generating device (3) comprising a pair of magnetic rollers. The first magnetic roller of the pair of magnetic rollers is located above the top side O of the strip while the second magnetic roller 5 is positioned under the strip underside U.

The distance a between the magnetic rollers 4.5 and the strip B is adjustable by means of adjusting devices which are not shown here and which are connected to controls which are also not shown here. In addition, the rotational speeds of the magnetic rollers 4, 5 can be changed by means of these controls. The magnetic rollers 4, 5 rotate in opposite directions so that their direction of rotation R in the area of the air gap L between the magnetic rollers 4, 5 are both contrary to the conveying direction F.

On the circumferential surface of the magnetic rollers 4, 5 and in alternating succession the permanent magnets 6, 7 are installed, of which the permanent magnets 6 are of opposite polarity to the adjoining magnetic poles 7. The magnetic rollers 4, 5 are driven in synchronicity with each other in such manner that two opposite poles 6, 7 are always facing each other in the area of the air gap L. By rotating the poles 6, 7 in opposite directions the braking action can also be influenced.

The magnetic rollers 4, 5 are surrounded by a casing which is made in the manner of a sleeve and is made of an elastic material. The casing 8 is driven independently of the magnetic rollers 4, 5 and rotates at a circumferential speed which is equal in magnitude and direction to the direction of travel (F) of the strip (B) in the area of the air gap L. This casing 8 makes it possible to use the device 1 without any difficulty for the braking of ferro-magnetic strips B by decreasing the distance a between the magnetic rollers 4, 5 and the strip to such extent that the casing 8 touches the strip surface O, U and provides a reliable protection against adherence of the strip B to the circumferences of the magnetic rollers 4, 5.

By adjusting the distance a and the rotational speed of the magnetic rollers 4, 5 the braking force exerted on strip B is conveyed to the not-shown winding device in a strip suitable for a straight, tight coil.

We claim:

1. Device to brake an electrically conductive strip (B) which is located before a station for further processing in which the strip is processed under tensile stress and which is provided with a magnetic field generating device (3) which alternates an alternating magnetic field which induces eddy currents into the strip (B) which exert a force on said strip (B) that is contrary to the direction of its travel (F), whereby the magnetic field generating device (3) comprises at least two magnetic rollers (4, 5) rotating in a direction contrary to the direction of travel (F) of the strip (B) and are aligned at a right angle to the direction of travel of the strip (B) and which being provided with magnetic poles (6, 7) of different polarities that are placed in alternating sequence on its circumferential surface, whereby at least one magnetic roller (4) is assigned to the top (O) and at least one additional magnetic roller to the underside (U) of the strip (B), characterized in that each of the magnetic rollers (4, 5) is surrounded by a casing (8) made of a non-conductive material and in that they form an air gap (L) through which the strip (B) can be guided without contact with the magnetic roller (4, 5).

2. Device as in claim 1 characterized in that the distance (A) between the magnetic rollers (4, 5) and the strip (B) can be adjusted.

3. Device as in claim 1, characterized in that the magnetic poles (6, 7) of the magnetic roller (4, 5) are permanent magnets.

4. Device as in claim 1, characterized in that the magnetic poles (6, 7) of the magnetic roller (4, 5) are solenoids.

5. Device as in claim 1, characterized in that the casing (8) is elastic.

6. Device as in claim 1, characterized in that in that the casing (8) is made in the manner of a sleeve and is driven independently of the magnetic rollers (4, 5).

* * * * *